US008333001B2

(12) United States Patent
Halliar et al.

(10) Patent No.: US 8,333,001 B2
(45) Date of Patent: Dec. 18, 2012

(54) METHOD OF SHORTENING A WELL CAR

(75) Inventors: William R. Halliar, Whiting, IN (US); Frank F. Stec, Downers Grove, IL (US); Bruce E. Keating, New Albany, MS (US)

(73) Assignee: TTX Company, Chicago, IL (US)

( * ) Notice: Subject to any disclaimer, the term of this patent is extended or adjusted under 35 U.S.C. 154(b) by 1401 days.

(21) Appl. No.: 11/858,735

(22) Filed: Sep. 20, 2007

(65) Prior Publication Data

US 2009/0078152 A1 Mar. 26, 2009

(51) Int. Cl.
*B23P 19/02* (2006.01)

(52) U.S. Cl. ..... 29/426.4; 29/401.1; 29/897; 29/897.2; 105/404; 105/411; 280/785; 410/94

(58) Field of Classification Search ..... 29/401.1, 29/426.4, 897.1, 897.2; 105/248, 355, 404, 105/411; 280/785; 410/94
See application file for complete search history.

(56) References Cited

U.S. PATENT DOCUMENTS

| | | | | |
|---|---|---|---|---|
| 4,696,237 | A * | 9/1987 | Miller | 105/248 |
| 5,482,323 | A * | 1/1996 | Hicks | 280/785 |
| 5,520,489 | A * | 5/1996 | Butcher et al. | 410/94 |
| 6,609,284 | B2 * | 8/2003 | Sheridan et al. | 29/401.1 |
| 6,877,226 | B2 * | 4/2005 | Khattab | 29/897.2 |
| 7,757,610 | B2 * | 7/2010 | Saxton et al. | 105/404 |
| 2007/0261593 | A1 * | 11/2007 | Saxton | 105/404 |
| 2009/0078152 | A1 * | 3/2009 | Halliar et al. | 105/355 |

OTHER PUBLICATIONS

"Container Application of Cones, Guides and Spacers," TTX Company, 13382 (Nov. 7, 2002).
"Equipment Modification Procedure No. EMP-32," TTX Company, 20 pages (issued Jun. 19, 2003; revised Jan. 13, 2005).
"Floor Support Modification," TTX Company, 13384 (Aug. 29, 2002).
"General Arrangement Corner Conditions," TTX Company, 13346 (Oct. 10, 2002).
"General Arrangement Side Conditions," TTX Company, 13457, 13459 (Jan. 7, 2003).
"General Arrangement Tolerances," TTX Company, B-13383 (Nov. 7, 2002).
"General Arrangement Well Shortening," TTX Company, 13456 (Jan. 7, 2003).
"General Arrangement Well Shortening," TTX Company, 13452 (Feb. 7, 2003).

(Continued)

*Primary Examiner* — Richard Chang
(74) *Attorney, Agent, or Firm* — Brinks Hofer Gilson & Lione

(57) ABSTRACT

A method of shortening an end of a well car includes removing a plurality of parts that would inhibit the shortening process; cutting a shear plate and a set of side sill angles at a location on the well side of the end assembly; detaching the end assembly from a main body of the well car; on each side of the main body: cutting the top tube at a location above a monument plate that is just beyond a reinforcement plate attached to the monument plate; cutting through a weld between the monument and reinforcement plates and a side sheet; cutting through the side sheet generally at the attachment location of the monument and reinforcement plates; and cutting the shear plate of the main body with a contoured cut such that the remaining shear plate has a contoured pattern substantially matching the cut shear plate under the removed end assembly.

18 Claims, 12 Drawing Sheets

OTHER PUBLICATIONS

Maintenance Instruction No. 37-551, TTX Company, 11 pages (issued Feb. 8, 1999; revised Jun. 11, 2003).
"Side Sill Application of Interior Post," TTX Company, 13362 (Oct. 22, 2002).
"Side Sill Side Post," TTX Company, 13363, 13365 (Oct. 29, 2002).
"Side Sill Side Post Assembly," TTX Company, 13368 (Oct. 30, 2002).

* cited by examiner

METHOD OF SHORTENING A WELL CAR

BACKGROUND

1. Technical Field

The disclosed embodiments relate to a method of shortening a rail car, and more specifically, to a method of shortening an end of a well car.

2. Related Art

Freight shipping containers are widely used to transport a variety of goods and products on ships, barges, railroads and over-the-highway vehicles. Container transport is very efficient since it minimizes labor costs, damage to goods and products and reduces the opportunities for pilferage and vandalism.

Containers come in different but standardized lengths. The lengths most widely used are 20, 35, 40, 45, 48, and 53 feet long. To the extent possible, the railroad cars which transport containers must be able to accommodate as many different container lengths as possible.

Well cars have a three to four foot wall along the sides and are built to a certain length according to the expected size of containers to be carried therein. The container fleet in the United States is quickly evolving into three basic sizes: 20 and 40 foot long international containers that arrive from overseas on ships and 53 feet long containers that are used domestically. The once common 45 foot and 48 foot containers are being replaced with 53 foot containers as they are retired or scrapped.

The majority of the current well car fleet includes 48 foot long wells that carry the 20 and 40 foot long international containers. Despite this, the limited track spaces at the ports where the container ships unload make the longer 48 foot wells inefficient. To handle the increased container traffic from both overseas and domestic sources, most new well cars will be 53 feet in length and the existing 48 foot fleet will continue to inefficiently carry the 20 and 40 foot long containers, if they are used at all. There is a need to retrofit existing 48 foot well cars to more efficiently carry the 20 and 40 foot international containers.

SUMMARY

By way of introduction, the various embodiments described below are drawn to a method of shortening a well car. Additional detail and other embodiments will be discussed in the Detailed Description.

In a first aspect, a method of shortening an end of a well car includes removing a plurality of container guides, corner posts, and corner post reinforcements from the inside corners of the well car; cutting a set of top tubes at a location on a well side of an end assembly; cutting a shear plate and a set of side sill angles at a location on the well side of the end assembly; detaching the end assembly from a main body of the well car; on each side of the main body: cutting the top tube at a location above a monument plate that is just beyond a reinforcement plate attached to the monument plate; cutting through a weld between the monument and reinforcement plates and a side sheet; cutting through the side sheet generally at the attachment location of the monument and reinforcement plates; and cutting the shear plate of the main body with a contoured cut such that the remaining shear plate has a contoured pattern substantially matching the cut shear plate under the removed end assembly.

In a second aspect, a method of shortening an end of a well car includes removing a plurality of parts that would inhibit the shortening process, or that need to be modified later in the shortening process; cutting a set of top tubes at a location on a well side of an end assembly; cutting a shear plate and a set of side sill angles at a location on the well side of the end assembly, thereby causing the end assembly to become detached from a main body of the well car; on each side of the main body: cutting the top tube at a location above a monument plate that is just beyond a reinforcement plate attached to the monument plate; cutting through a weld between the monument and reinforcement plates and a side sheet; cutting through the side sheet generally at the attachment location of the monument and reinforcement plates; cutting the shear plate of the main body with a contoured cut such that the remaining shear plate has a contoured pattern substantially matching the cut shear plate under the detached end assembly; removing, from each side of the well car, the reinforcement plate and the cut portions of the top tube and the side sheet; and removing the cut shear plate from the main body.

In a third aspect, a method for re-attaching a removed end assembly to a main body of a well car, wherein on each side of the well car there is a top tube on both the main body and the end assembly, the method including: providing a plurality of back-up bars, each back-up bar having a first end and a second end, the second end having a plurality of tabs defined thereon and the backup bar substantially matching the internal perimeter of the top tube; insertably mating the plurality of tabs on the second end of each back-up bar into respective top tubes of the main body, wherein a gap remains between corresponding top tubes of the end assembly and those of the main body; welding each gap shut; welding the end assembly onto a shear plate of the main body; and welding a bulkhead angle into each corner defined between the end assembly and the main body.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

In some cases, well known structures, materials, or operations are not shown or described in detail. Furthermore, the described features, structures, or characteristics may be combined in any suitable manner in one or more embodiments. It will also be readily understood that the components of the embodiments as generally described and illustrated in the Figures herein could be arranged and designed in a wide variety of different configurations.

The 48 feet long well cars are inefficient when they carry 20 or 40 feet long international containers because not all the space is used, and the chain of rail cars unnecessarily increases in length. Furthermore, the unnecessary length significantly adds to the weight and increases costs of hauling the containers. Thus, to avoid these unnecessary costs and to simultaneously put to use the tens of thousands of 48 foot long well cars, a method is proposed that streamlines the shortening of the well car. Scrap metal obtained during the process may be recycled and some parts removed during shortening may be reused.

Figure 1:
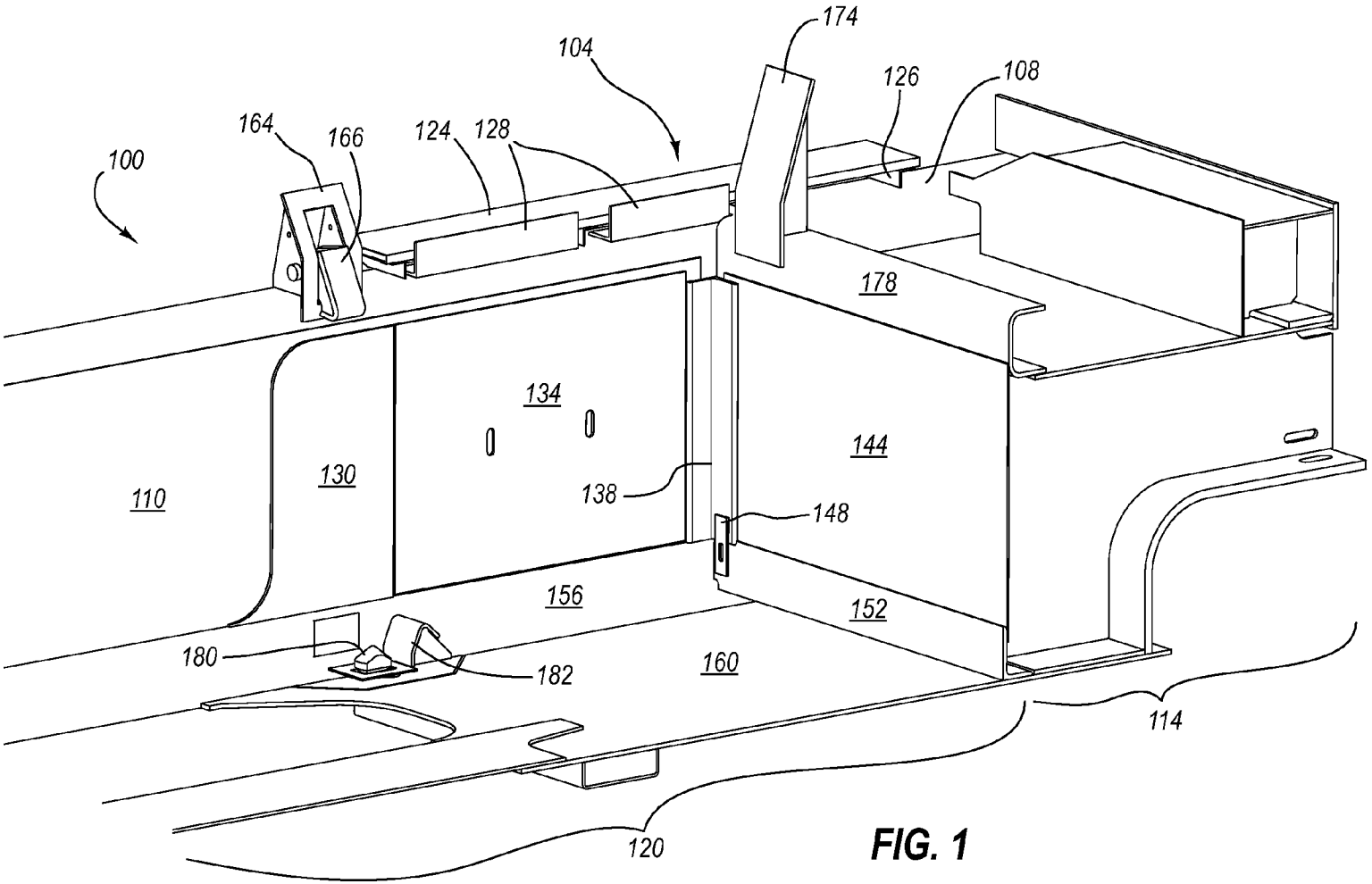
FIG. 1 is a perspective view of an inside corner of a well car before shortening.
Figure 2:
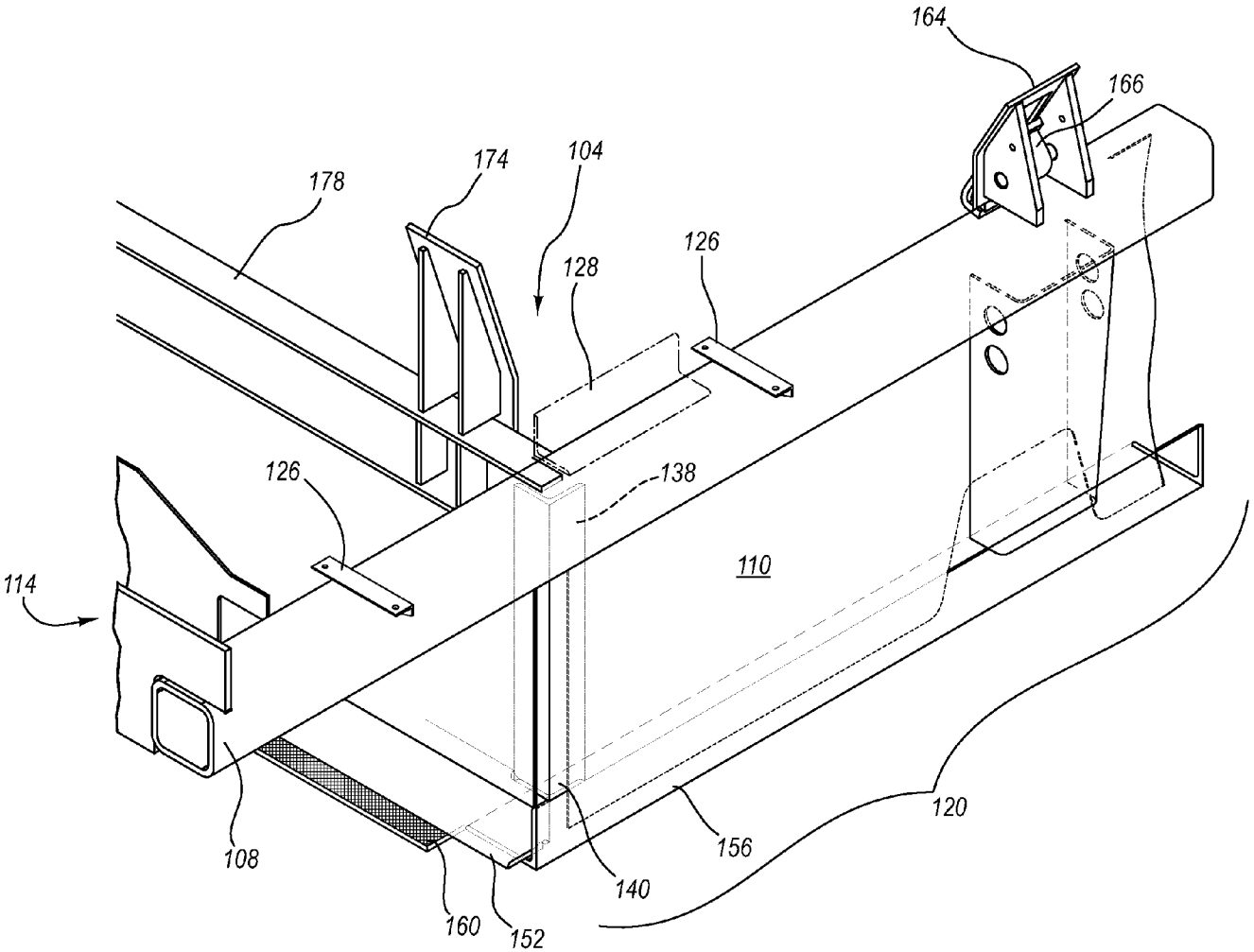
FIG. 2 is a perspective view of the outside of the corner of the well car of FIG. 1 with a running board removed.

FIG. 1 is a perspective view of a well car 100, showing the inside of a corner 104 before shortening. FIG. 2 is a perspective view of the well car 100 from outside of the same corner 104. The other three corners of a typical well car 100 are substantially identical. A top tube 108 runs along the top of a side sheet 110 and an end assembly 114 of the well car. The end assembly 114 sits at the end of the well car and is also referred to as a bulkhead. In general, the end assembly 114 may be removed in its entirety after it is unwelded and severed from a main body 120. A running board (or grating platform) 124 sits on top of the top tube 108. A plurality of running board brackets 126 are used to attach the running board 124 to the top tube 108. Additionally, one or more kick plates 128 are attached to the inside of the running board 124 as a safety mechanism so that a person standing on the running board 108 to help guide a container into the well car 100 can avoid injuring his feet during the process.

A monument plate 130 is welded to the side sheet 110 and to a reinforcement plate 134. A corner post 138 is welded into the corner 104 to cover a gap 140 that is normally present between the side sheet 110 and a face sheet 144 of the end assembly 114. A corner post reinforcement 148 may be used at the bottom of the corner post 138 to secure it to a bottom bulkhead angle 152 of the end assembly 114. Note that the corner post 138 is usually welded to the side sheet 110 of the main body 120 and to the face sheet 144 of the end assembly 114. The corner post 138 may also include a reinforcement weld to the side sill angle 156 that runs along the bottom of the side sheet 110, in addition to a reinforcement weld to the bottom bulkhead angle 152 that may be used in lieu of the corner post reinforcement 148. The bottom of the well car 100 includes a shear plate 160 that runs underneath the end assembly 114 and underneath the side sill angle 156. The shear plate may be shaped so that it matches the shape of the underside of the end assembly 114 to which it is attached.

A width adjuster 164 is attached on top of the top tube 108 generally above the monument plate 130 and includes a rotatable flipper 166 that may be used to quickly adjust the width of the well car 100 depending on the position of the flipper 166. A longitudinal guide 174 is attached on top of a top bulkhead angle 178 of the end assembly 114. The longitudinal guide 174 is used to guide a container into the inside of the well car 100. A cone 180 is attached to the shear plate 160 and a container stop 182 is attached near the cone 180 on the end assembly 114 side of the cone 180. A corresponding aperture on the bottom of a container interacts with the cone 180 to lock the container in place. The container guide 182 is used as an interim longitudinal guide for containers placed in the well car 100 that are shorter than the length of the well car 100. After the shortening process the container guide 182 is not needed as the longitudinal guide 174 is used for its intended purpose of guiding a container snugly into a space within the well of the well car 100 that matches the length of the container.

Note that the present method of shortening the well car 100 as described herein, for simplicity, is generally described with reference to a corner 104. The same steps, however, can be simultaneously carried out on a corner (104' in FIG. 6) opposite the corner 104 of the well car 100 to equally shorten the entire end of the well car 100. Furthermore, the process may also be carried out on the corners of the opposite end of the well car 100. Accordingly, when one part or structure is referred to, inferred is reference to more than one as the corner 104' substantially mirrors corner 104.

Figure 3:
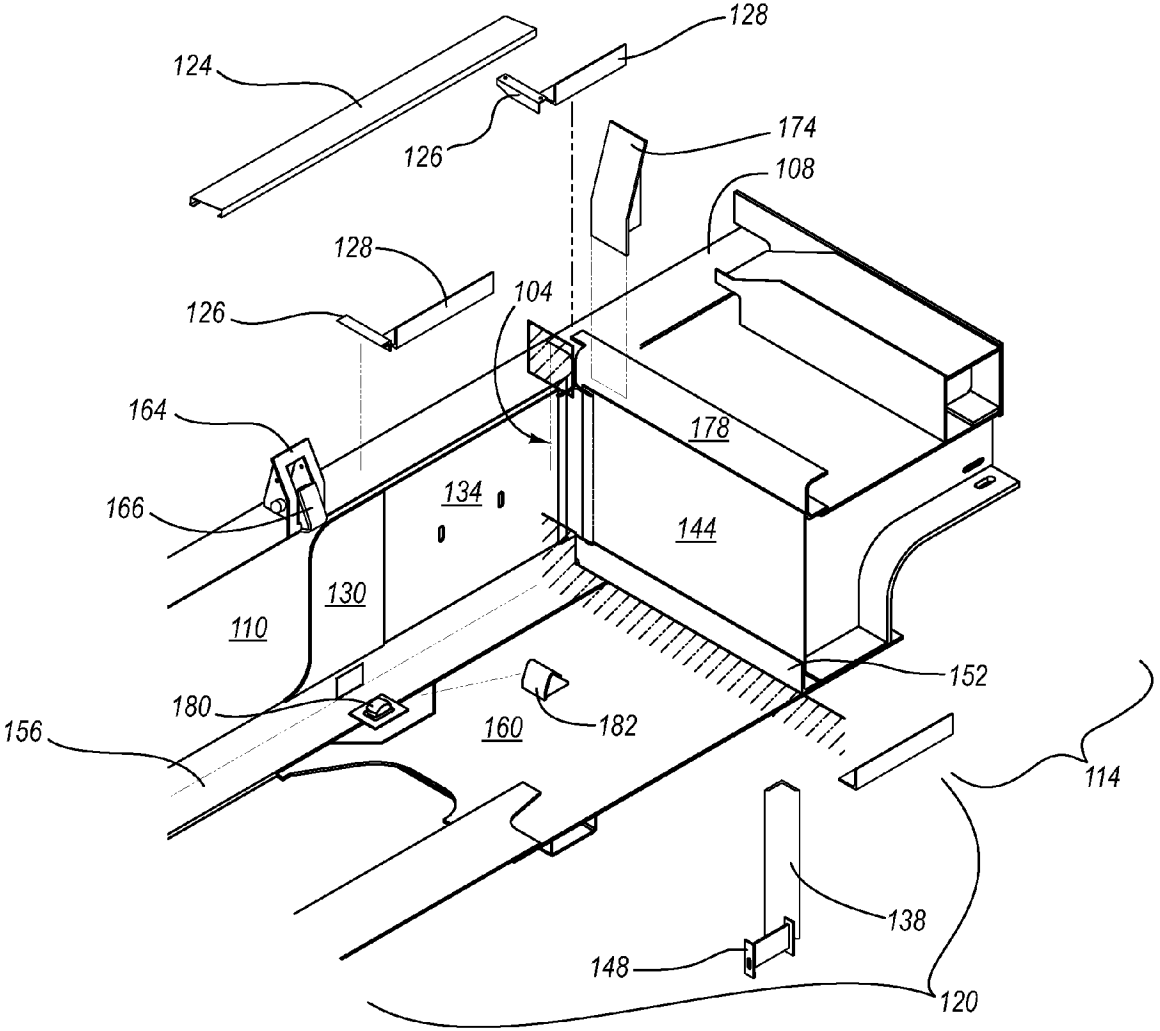
FIG. 3 is a perspective view of the inside corner, as shown in FIG. 1, showing initial removal of various guides and brackets to prepare to shorten the well car.

FIG. 3 is a perspective view of the inside of the corner 104, as shown in FIG. 1, showing initial removal of certain parts as discussed with reference to FIGS. 1 and 2. Removing these parts prepares the end assembly 114 for detachment, and readies the well car 100 for removal of a section of the main body 120 to execute the shortening process. As mentioned, some of the parts that are removed may be scrapped for recycling and others are reused in the reassembled well car 100. The running board 124, running board brackets 126, and kick plates 128 are all removed and scrapped. The container guide 182, the corner post 148, and the corner post reinforcement 148 are removed as well. The container guide 182 is scrapped, and the corner post 148 and the corner post reinforcement 148 may optionally be reused later during reassembly.

Removal of the corner post 138 proceeds by first unwelding it from the side sheet 110 and the face sheet 144. Reinforcement welds at the side sill angle 156 and/or the bottom bulkhead angle 152 are also unwelded if they are present. FIG. 3 also shows the removal of the longitudinal guide 174, but this is primarily to protect it during the shortening process as it need not be removed until later when it is modified (see FIG. 10). Next, the shear plate 160, the side sill angle 156, and the top tube 108 are cut in order to detach the end assembly. Note that the shaded area in FIG. 3 indicates where the shear plate 160, the side sill angle 156, and the top tube 108 are cut in order to detach the end assembly 114.

Figure 4:
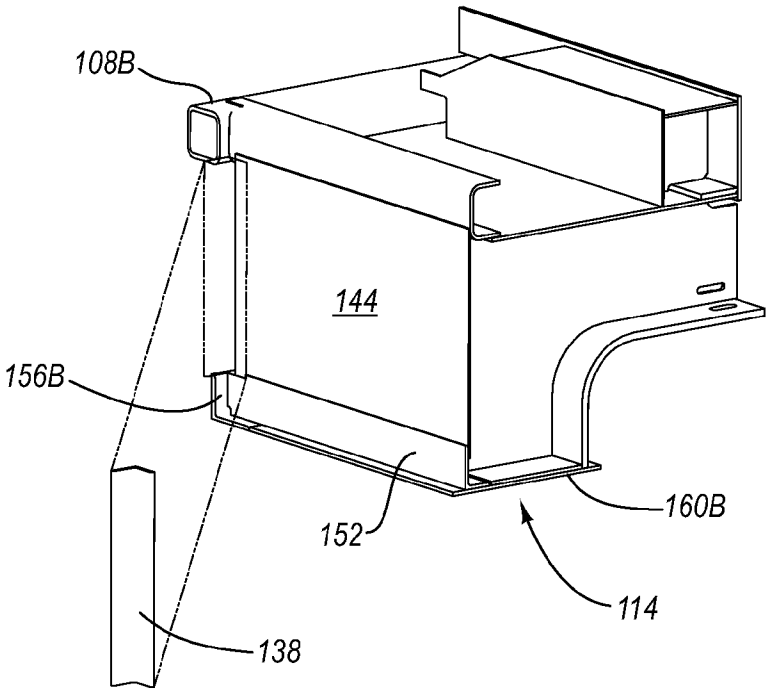
FIG. 4 is a perspective view of the detached end assembly of the well car of FIG. 1 and the state of the main body after detachment.
Figure 4:
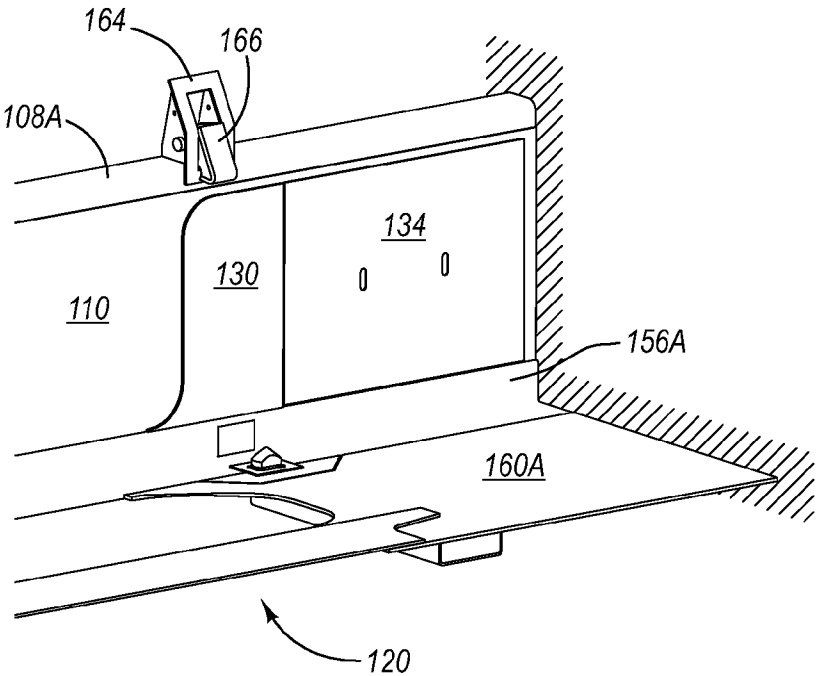

FIG. 4 is a perspective view of the detached end assembly 114 and the state of the main body 120 after detachment. After the top tube 108, the side sill angle 156, and the shear plate 160 are cut (e.g., with a blow torch or other method as practiced in the art) along the lines indicated by shading in FIG. 4, the end assembly 114 is removed, leaving the end assembly 114 detached so it can be prepared for reattachment after the main body 120 is shortened. After detachment, the side sill angle 156 is split into two pieces: a section 156A of the main body 120 and a small piece 156B that remains on the end assembly 114. Likewise, the top tube 108 is split into two pieces: a section 108A of the main body 120 and a section 108B that remains on the end assembly 114. Finally, the shear plate 160 is split into two pieces: a section 160A of the main body 120 and a section 160B that remains attached under the end assembly 114.

Figures 5A, 5B:
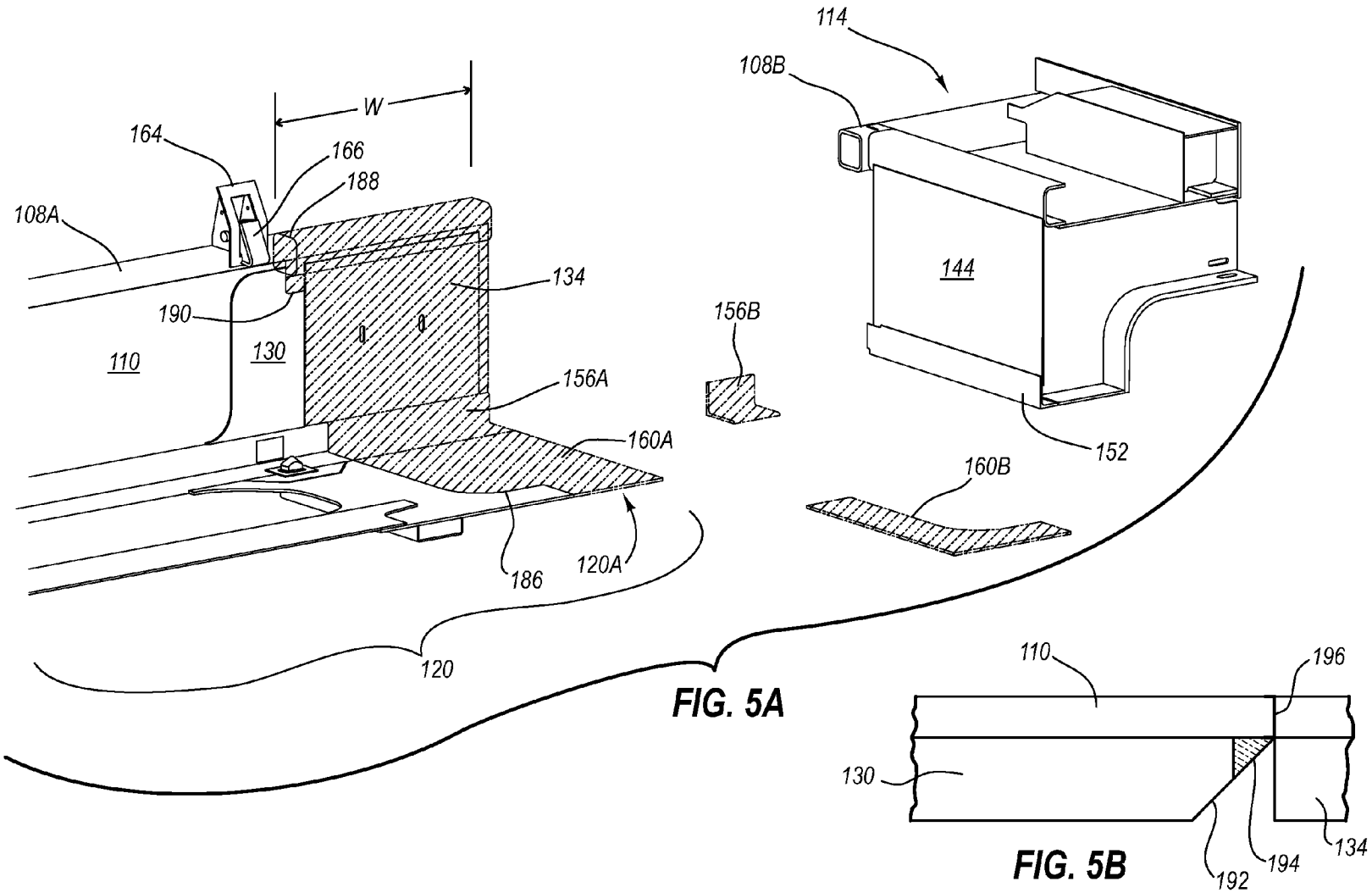
FIG. 5A is a perspective view of the inside corner of the well car of FIG. 1, highlighting a section of a main body of the well car to be removed to execute shortening.
FIG. 5B is a top section view of the side sheet and monument plate of the inside corner of FIG. 5A, showing a diagonal cut of the monument plate that preserves a weld between it and the side sheet.
Figure 6:
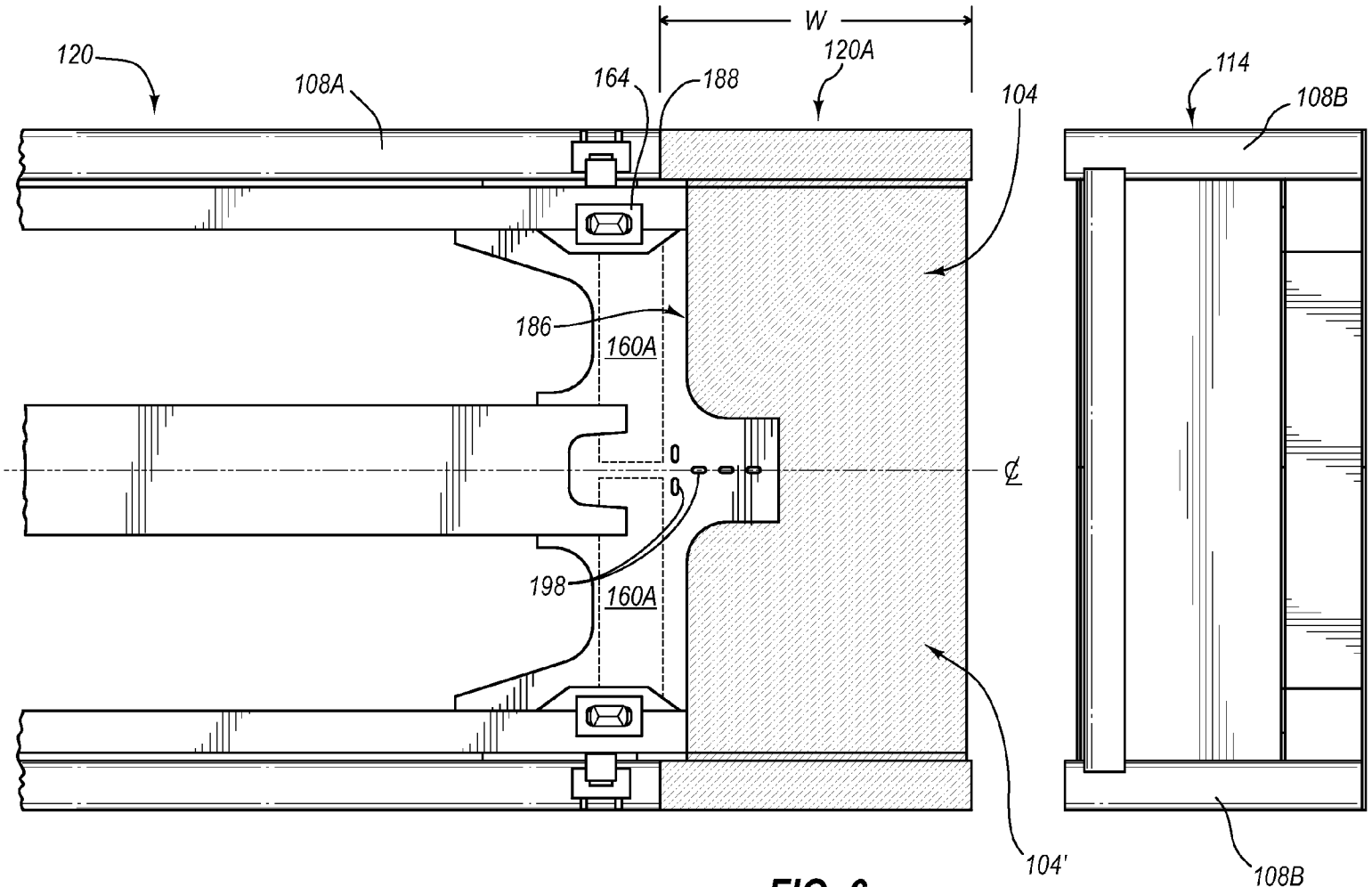
FIG. 6 is a plane view of an end of the well car of FIG. 1 including two opposing corners and showing a contoured pattern in a shear plate of the main body.

FIG. 5A is a perspective view of the inside of the corner 104 of the well car 100, highlighting a section 120A of a main body 120 of the well car that is removed in the shortening procedure. FIG. 6 is a plane view of the end of the well car 100 including two opposing corners 104 and 104' and showing a contoured pattern 186 in the shear plate 160A. FIG. 6 makes clear that normally the entire end of the well car is shortened in a set of steps that includes both corners 104 and 104', and that the end assembly 114 usually remains as an integral piece during shortening. Note also that in FIGS. 5 and 6, a shaded section 120A is that portion of the main body 120 that will be removed in the shortening procedure.

The top tubes 108A are cut again at a location 188 just inside of the monument plates 130. This leaves room to define a notch 190 in an upper, outside corner of the monument plate 130. This notch 190 creates sufficient space to later weld together the top tube 108A of the main body to the top tube 108B of the end assembly 114 at each corner 104 and 104'.

FIG. 5B is a top section view of the side sheet 110 and the monument plate 130, showing a diagonal cut 192 of the monument plate 130 that preserves a weld 194 between it and the side sheet 110. Before removing the reinforcement plate 134, a weld exists between the reinforcement plate 134 and the monument plate 130 and the side sheet 110. This weld must be undone or cut through so as to separate (and remove) the reinforcement plate 134 from the well car 100. The side sheet 110 must also be cut through, for instance at a location 196 shown in FIG. 5B, so that the shaded section thereof (120A) may also be removed. The existing weld may be cut through so as to preserve the portion of the weld (194) between the monument plate 130 and the side sheet 110 at the new end of the main body 120 after detachment of the shaded section 120A. Making a diagonal cut 192 at an outside edge of the monument plate 130 preserves the weld 194.

The shear plate 160A is cut again with the contoured pattern 186 that substantially matches the underside of the end assembly 114 to which it will be reattached. Indeed, the shear plate 160B is left underneath the end assembly 114 after the end assembly 114 is detached from the main body 120. This portion of the shear plate 160B is shown separately for clarification of its contoured pattern. The portion of the side sill angle 156B is similarly shown separate, but remains attached to the end assembly 114 after detachment. Both portions of the side sill angle 156B and the shear plate 160B are then removed by unwelding or otherwise cutting them from the end assembly 114, followed by grinding the end assembly 114 to prepare the end assembly 114 for re-welding to the main body 120.

After the above-mentioned processes are complete, the shaded section 120A, which has a length W, is then removed from the main body. To efficiently fit a 40 foot long container, a 48 foot long well 100 car will have an approximately 4 foot section 120A removed from each end of the well car 100. The length W of the removed top tube 108A may actually be about 3 feet, 8 and $\frac{7}{8}^{th}$ inches so as to provide some additional space as play for adjusting the longitudinal guides 174 within a tolerance length of different containers. Currently, the tolerance of the well length is about plus one-half inch and minus zero inches between longitudinal guides. (Additionally, as will be explained with reference to FIGS. 7A and 7B, the weld between the top tubes 108A and 108B after mating them together in reassembly leaves a gap of about $\frac{3}{8}^{ths}$ of an inch that is filled upon welding.) The removed side sheet 110, reinforcement plate 134, and shear plate 160A, therefore, are of a length slightly shorter than length W.

Figure 7B:
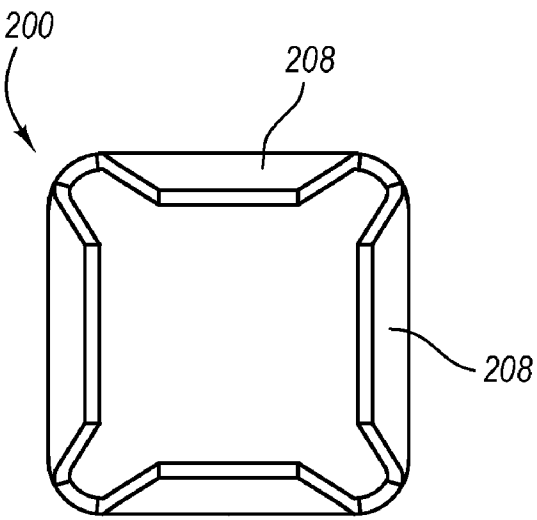
FIG. 7B is an end view of the backup bar of FIG. 7A, showing tabs bent inwardly to help guide the top tube of the main body onto the backup bar previously inserted into the top tube of the end assembly.
Figure 7A:
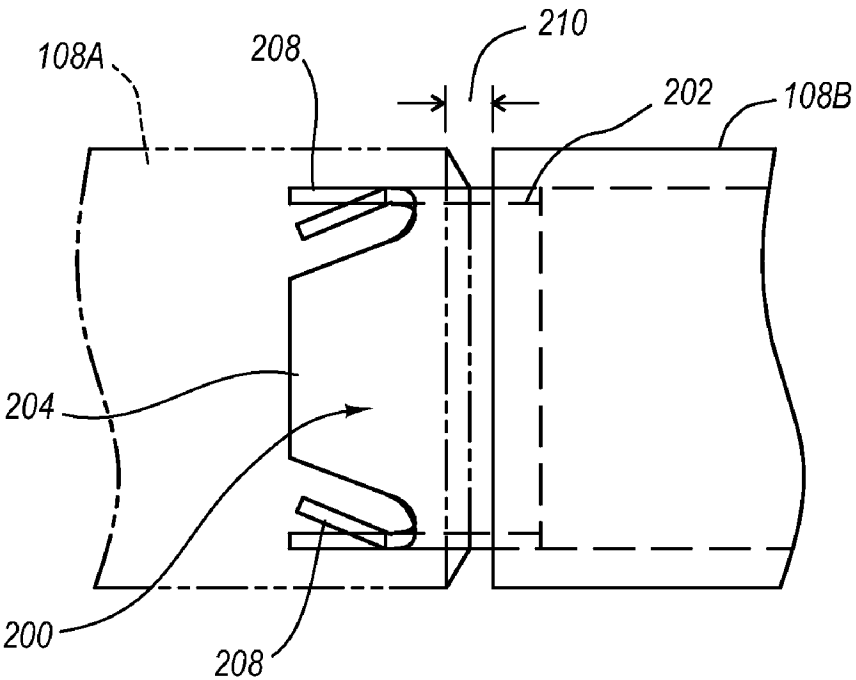
FIG. 7A is a side view of a backup bar being insertably mated between top tubes of the main body and the end assembly.

At least the top tubes 108A is chamfered at the cut edge thereof to prepare it to be re-welded to top tube 108B. The cut edge of top tube 108B may optionally be chamfered in a direction corresponding to the chamfered edge of top tube 108A. Chamfering, however, is typically done just on one side to comply with American Welding Society (AWS) welding standards. A plurality of slots (or apertures) 200 may also be formed in the contoured patterned area 186 of the remaining shear plate 160 through which to weld the end assembly 114 back onto the shear plate 160. The cutting and welding steps disclosed herein are carried out with methods of those skilled in the art of metallurgy. After the end assembly 114 and the main body 120 have been separated from each other and prepared for reassembly, it can be difficult to mate together again for re-welding, especially the top tubes 108A and 108B. This difficulty arises at least because of the large sizes and weights of the end assembly 114 and the main body 120. FIGS. 7A and 7B show a device developed to ameliorate this difficulty and for use in the present methods.

FIG. 7A is a side view of a backup bar 200 insertably mated between the top tubes 108A of the main body 120 and the top tubes 108B of the end assembly 114. The backup bar 200 includes a fairly shallow solid first end 202 that fits in the top tubes 108B of the end assembly 114, and a deeper pronged second end 204 that includes a plurality of tabs 208. FIG. 7B is an end view of the backup bar 200, showing the tabs 208 bent inwardly. After the solid end 202 is tacked in place into the top tubes 108B of the end assembly 114, the tabs 208 are bent inwardly (if not already bent that way), as shown. The tabs 208 provide a guide to the ends of the sections 108A, 108B when reassembling the main body 120 and the end assembly 114. As the top tubes 108B of the end assembly 114 with the backup bars 200 move towards the main body 120, the tabs 208 of the backup bars 200 slide inside the top tubes 108A of the main body 120, greatly facilitating mating the end assembly 114 back onto the main body 120. A gap 210 of about ⅜ths of an inch remains after complete mating, allowing a strong, 360-degree weld to be formed therein that may withstand up to a million of pounds of force.

After the end assembly 114 and the main body 120 are reassembled, as discussed previously, the longitudinal guide 174 can then guide a container snugly into a space within the well of the well car 100 that matches the length of the container, as intended. Because a snug or efficient fit is desired, it is beneficial to make the longitudinal guide 174 slidable to adjust for slight tolerances in the lengths of the containers.

Figure 8B:
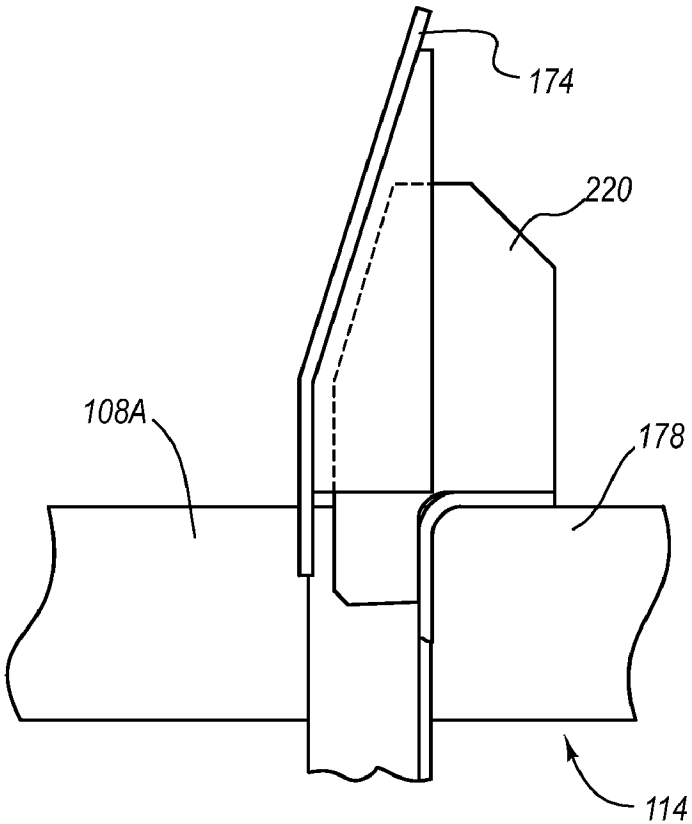
FIGS. 8A and 8B are, respectively, a top plane view and a side view of the addition of a slip joint as a modification of a longitudinal guide of the end assembly.
Figure 8A:
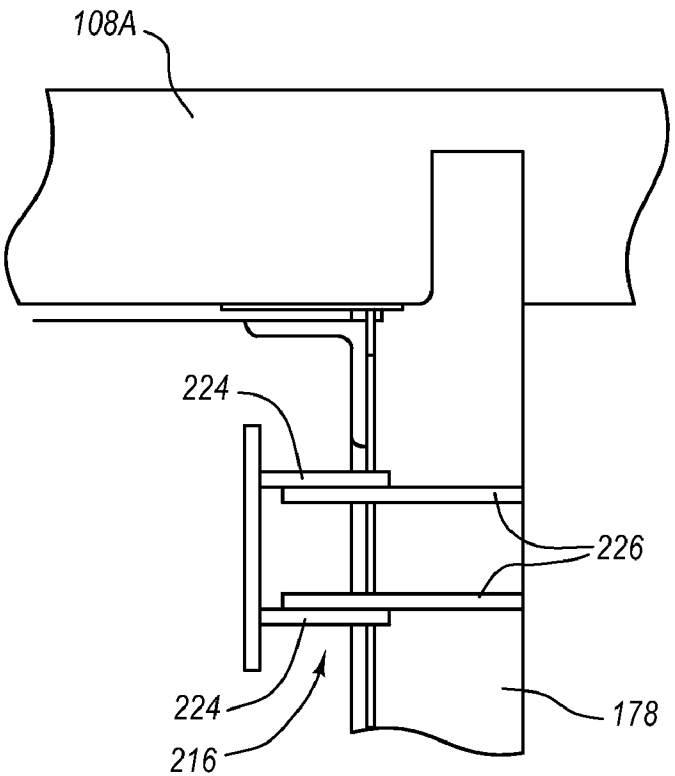

FIGS. 8A and 8B are, respectively, a top plane view and a side view of the addition of a slip joint 216 as a modification of the longitudinal guide 174 of the end assembly 114. The longitudinal guides 174 are attached to the top bulkhead 178 angles. The longitudinal guides 174 and corresponding guide rail assemblies 220 are removed from the ends of the well car 100. Each guide rail assembly 220 includes a first pair of gussets 224 that are attached to one of the bulkhead angles 178. A second pair of gussets 226 is attached to the top bulkhead angles 178 at the general location of removal of the longitudinal guides 174. The first pair of gussets 224 of each guide rail assembly 220 is then reattached to corresponding second pairs of gussets 226 such that the first and second pairs of gussets 224, 226 form the slidably adjustable slip joint 216. Each longitudinal guide 174 is then reattached to corresponding guide rail assemblies 220. The longitudinal guides 174 and the slidable joints 226 are used to adjust the length of the well car 100 between the longitudinal guides 174 on opposing ends of the well car 100.

The slip joint 216 modification allows a well car 100 operator to optionally extend the longitudinal guides 174 further towards the inside of the well car 100, thus effectively adjusting the length of the well car 100 so that the well fits more snugly against a container to prevent longitudinal movement of the container within the well. The slip joint 216 modification produces an adjustable well car length within a ½ inch tolerance, e.g. within ½ inch of typical 20 and 40 foot long containers.

Figure 9:
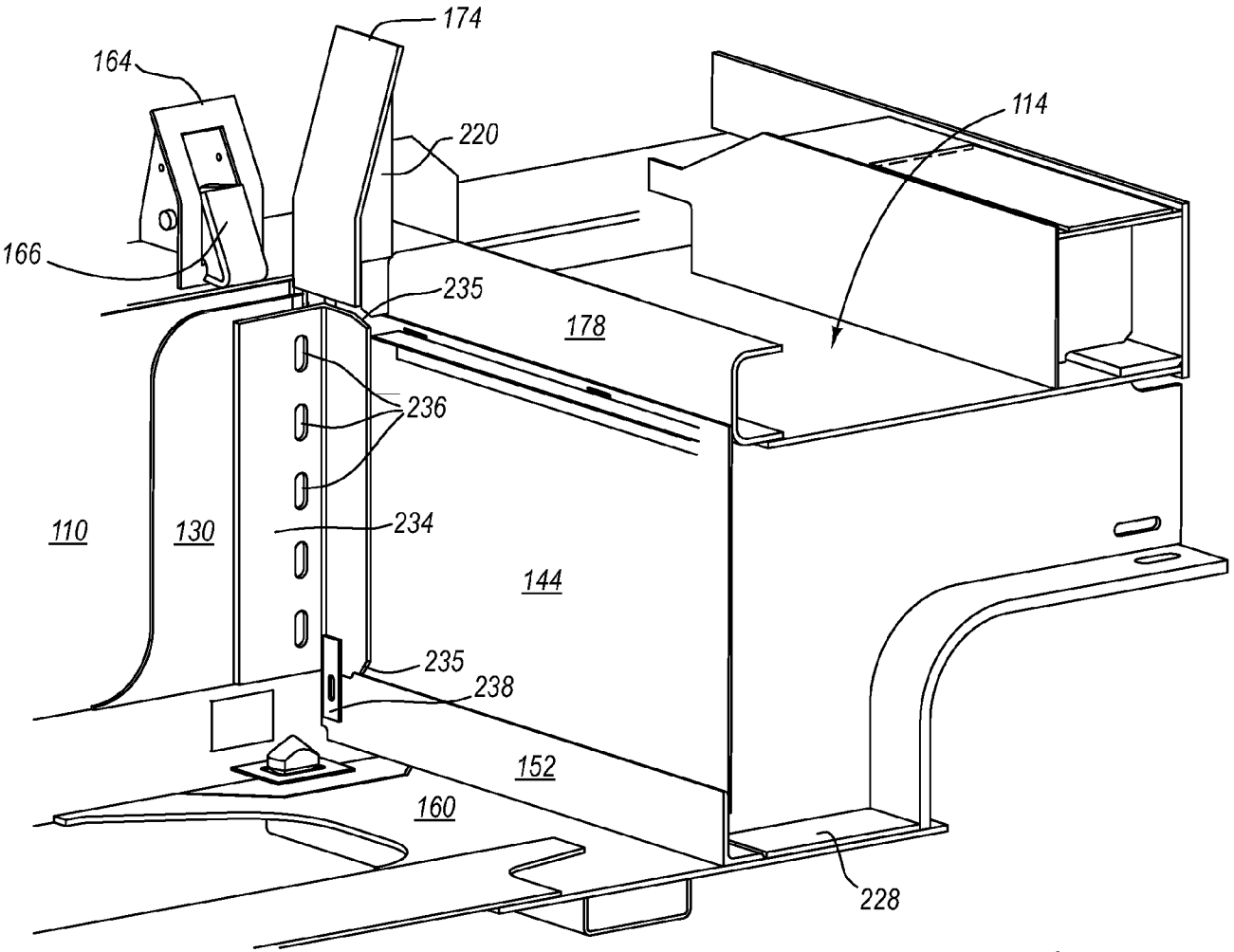
FIG. 9 is a perspective view of a corner of the reassembled well car of FIG. 1.

FIG. 9 is a perspective view of a corner 104 of the reassembled well car 100. The modification of the longitudinal guides 174 with a slip joint 216 was discussed with reference to FIGS. 8A and 8B. The mating of the main body 120 and the end assembly 114, together with welding the top tubes 108A and 108B to each other was discussed with reference to FIGS. 5 through 7. The end assembly 114 is also welded to the contoured portion 180 (FIGS. 5 and 6) of the shear plate 160. The welding may be performed through the apertures 198 formed through the shear plate 160 as discussed previously. In this process, the bottom bulkhead angle 152 and a stub sill bottom plate 228 are welded to the shear plate 160. The side sill angle 156 may also be welded to the bottom bulkhead angle 152.

A bulkhead angle 234 is employed as a replacement for the corner post 138. In preparation for welding the bulkhead angle 234 to the inside of the corner 104, the corners 235 of the bulkhead angle 234 that will be positioned on the face sheet 144 of the end assembly 114 are trimmed. A plurality of slots (or apertures) 236 may be pre-formed in the bulkhead angle 234 through which the bulkhead angle 234 may be welded to the monument plate 230 (and potentially also to the side sheet 110). Once the bulkhead angle 234 is welded into the corner 104, a bulkhead angle reinforcement 238 may be attached between the bulkhead angle 234 and the bottom bulkhead angle 152. Optionally, a reinforcement weld may also be placed between the bulkhead angle 234 and the bottom bulkhead angle 152. Furthermore, the side sill angle 156 is welded to the bulkhead angle 234. Each rotatable flipper 166 inside of respective width adjusters 164 is welded in place in a down position, setting the width of the well permanently to correspond to the 20 and 40 foot long international containers.

Figure 10:
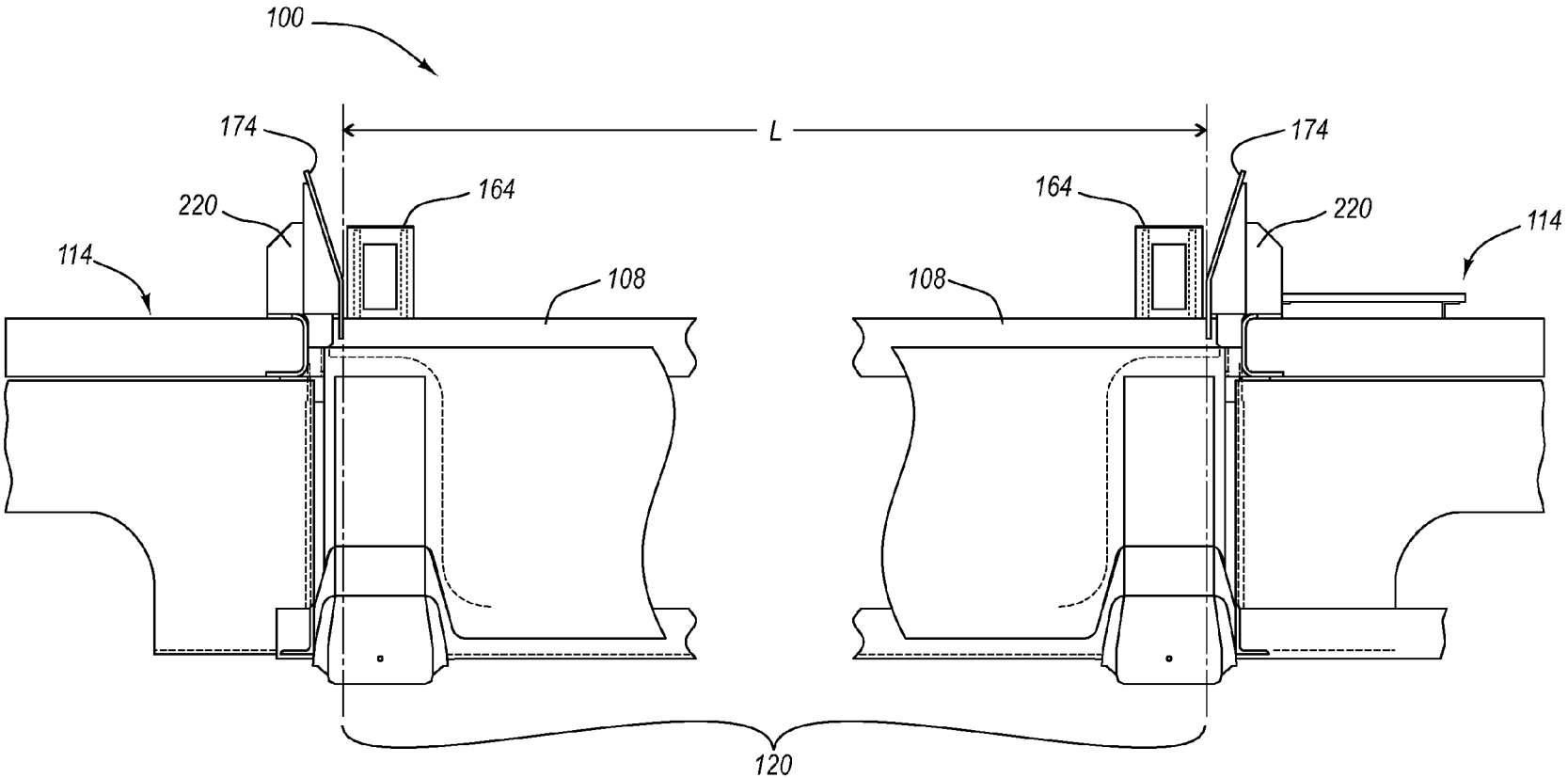
FIG. 10 is a side, cross-sectional view of the entire well car after shortening and reassembly at both ends of the well car.

FIG. 10 is a side, cross-sectional view of the entire well car 100 after shortening and reassembly at both ends of the well car. Note that the labeled parts correspond to like numbers as discussed in the previous Figures. Note also that the well of the well car 100 has a length L, which has now been effectively shortened from a 48 foot long well to a 40 foot long well of the well car 100, for instance.

Figure 11:
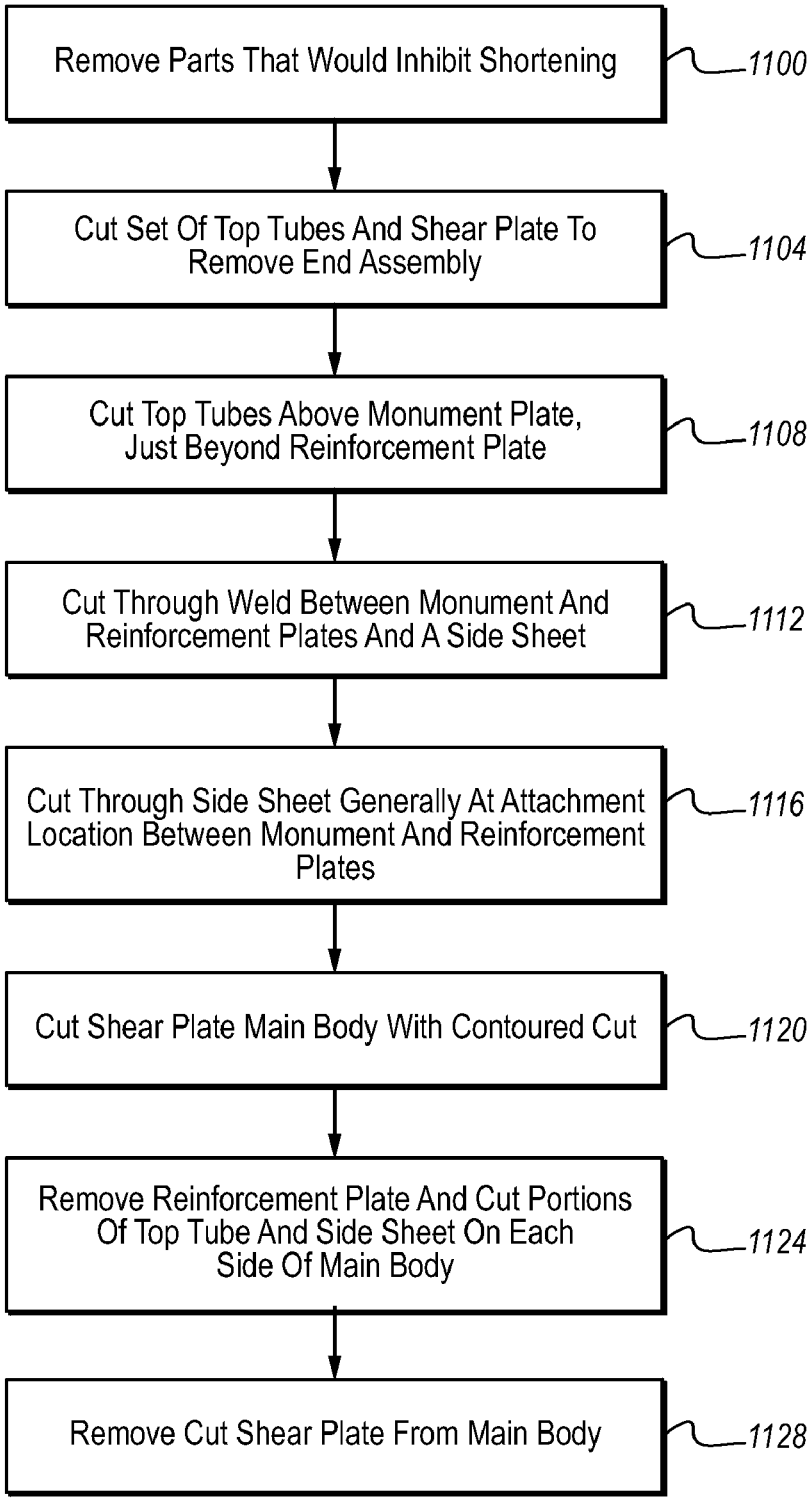
FIG. 11 is a flow chart of a method of shortening a well car in accordance with the present disclosure.

FIG. 11 is a flow chart of a method of shortening a well car 100 in accordance with the present disclosure, to reiterate the steps thereof as discussed herein. At step 110, parts are removed that would inhibit shortening. These parts would include container guides 182, corner posts 138, corner post reinforcements 148, longitudinal running boards 124, board brackets 126, and kick plates 128. At step 1104, a set of top tubes 108 are cut as is the shear plate 160 just inside of the end assembly 114 in order to remove the end assembly 114 from the main body 120. At step 1108, the top tubes 108 are again cut at a location above the monument plate, just beyond the reinforcement plate 134. At step 1112, a weld located between the monument and reinforcement plates 130, 134 and the side sheet 110 is cut. At step 1116, the side sheet 110 is cut through generally at an attachment location between the monument and reinforcement plates 130, 134. At step 1120, the shear plate 160 of the main body 120 is cut with a contoured pattern 186. At step 1124, the reinforcement plate 134 is removed along with cut portions of the top tube and the side sheet 110 on each side of the main body. At step 1128, the cut shear plate is removed from the main body 120. These are general overall steps for the shortening process, and contemplated are additional steps discussed herein and those routine steps apparent to those of skill in the art.

Figure 12:
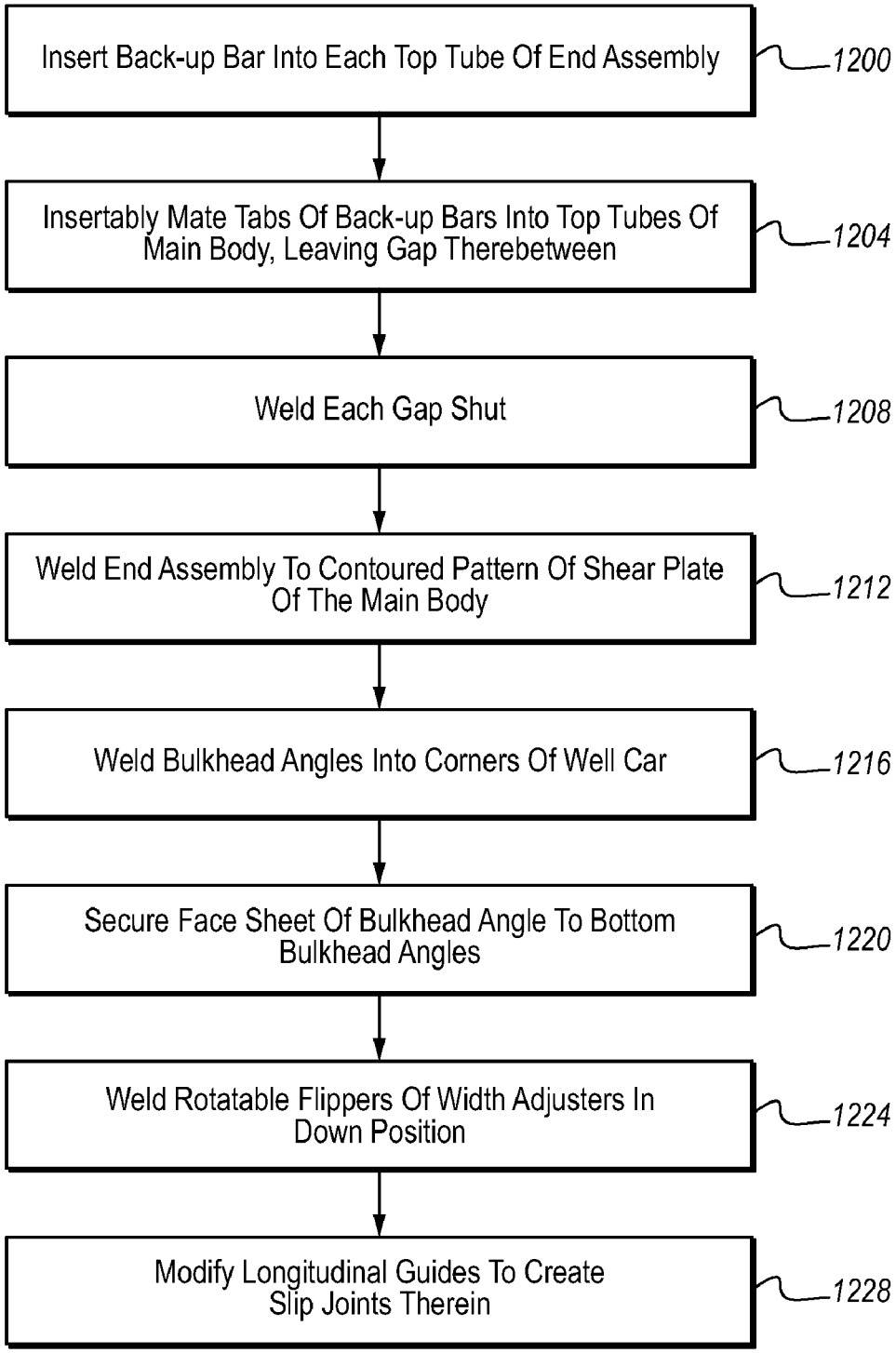
FIG. 12 is a flow chart of a method of reassembling a shortened main body with the end assembly in accordance with the present disclosure.

FIG. 12 is a flow chart of a method of reassembling a shortened main body 120 with the end assembly 114 in accordance with the present disclosure. At step 1200, a back-up bar 200 is inserted into each top tube 108B of the end assembly 114. At step 1204, tabs 204 of the back-up bars 200 are mated inside of the top tubes 108A of the main body 120, leaving a gap 210 therebetween. At step 1208, each gap 210 is welded shut. At step 1212, the end assembly 114 is welded to the contoured pattern 186 of the shear plate 160 of the main body 120. At step 1216, a bulkhead angle 234 is welded into each corner of the well of the well car 100. At step 1224, the flippers 166 of the width adjusters 164 are welded in the down position. And, at step 1228, the longitudinal guides 174 are modified to create slip joints 216 therein used to adjust the length (L) of the well of the well car 100 so that containers placed therein fit snugly and avoid longitudinal movement. These are general overall steps for the reassembling process, and contemplated are additional steps discussed herein and those routine steps apparent to those of skill in the art.

The terms and descriptions used herein are set forth by way of illustration only and are not meant as limitations. Those skilled in the art will recognize that many variations can be made to the details of the above-described embodiments without departing from the underlying principles of the invention. For example, the steps of the method need not be executed in a certain order, unless specified, although they may have been presented in that order in the disclosure. Those of skill in the art will appreciate that most of the steps within the disassembly and detachment of the end assembly 114 from the main body 120 are interchangeable, and that most of the steps for reassembly after shortening are interchangeable. Even some of the steps discussed above as being executed during reassembly, such as modification of the longitudinal guides 174, may occur before disassembly and detachment. The scope of the invention should, therefore, be determined only by the following claims (and their equivalents) in which all terms are to be understood in their broadest reasonable sense unless otherwise indicated.

The invention claimed is:

1. A method of shortening an end of a well car, said well car having at least four inside corner, the method comprising:

removing a plurality of container guides, corner posts, and corner post reinforcements from the inside corners of the well car;

cutting a set of top tubes at a location on a well side of an end assembly;

cutting a shear plate and a set of side sill angles at said location on the well side of the end assembly;

detaching the end assembly from a main body of the well car;

on each side of the main body:

cutting the top tube at a location above a monument plate that is just beyond a reinforcement plate attached to the monument plate;

cutting through a weld between the monument and reinforcement plates and a side sheet;

cutting through the side sheet generally at the attachment location of the monument and reinforcement plates; and cutting the shear plate of the main body with a contoured cut such that the remaining shear plate has a contoured pattern substantially matching the cut shear plate under the removed end assembly.

2. The method of claim 1, wherein the step of cutting the weld further comprises preserving a portion of the weld between the side sheet and the monument plate by trimming, with a diagonal cut, an outside edge of the monument plate when cutting through the weld.

3. The method of claim 1, further comprising:

cutting and removing a section of the side sill angle from each side of the end assembly;

removing the cut shear plate from beneath the end assembly; and grinding the underside of the end assembly where the side sill angle sections and the shear plate were removed.

4. The method of claim 3, further comprising:

removing, from each side of the main body, the reinforcement plate and the cut portions of the top tube and the side sheet; and removing the cut shear plate from the main body.

5. The method of claim 4, wherein the removed portion of the top tube is about 3 feet 8⅞ inches long, and wherein the removed portions of the reinforcement plate, the side sheet, and the shear plate each have a length slightly shorter than that of the removed portion of the top tube.

6. The method of claim 4, further comprising on each side of the well car:

chamfering the cut edge of at least one of the top tube of the main body and the top tube of the end assembly;

cutting a notch from the monument plate so as to receive therein the top tube of the end assembly; and defining at least one slot through the contoured pattern of the shear plate through which to weld the end assembly back onto the contoured pattern of the shear plate.

7. The method of claim 6, further comprising:

providing a plurality of back-up bars, each back-up bar having a first end and a second end, the second end having a plurality of tabs defined thereon and the backup bar substantially matching the internal perimeter of the top tube;

insertably mating the plurality of tabs on the second end of each back-up bar into respective top tubes of the main body, wherein a gap remains between corresponding top tubes of the end assembly and those of the main body;

welding each gap shut; and welding the end assembly onto the contoured pattern of the shear plate.

8. The method of claim 7, further comprising on each side of the well car:

preparing a bulkhead angle by trimming the corners thereof that are to be positioned on a face sheet of the end assembly;

welding the side sill angle of the main body to a bottom bulkhead angle of the end assembly;

welding the bulkhead angle to the monument plate generally at the inside corner of the well car; and securing the face sheet side of the bulkhead angle to the bottom bulkhead angle with at least one of a reinforcement bracket and a reinforcement weld.

9. The method of claim 8, further comprising on each side of the well car:

welding the side sill angle to the bulkhead angle; and welding the shear plate to the bottom of the bulkhead angle.

10. The method of claim 9, further comprising:

welding a plurality of rotatable flippers in a down position within a plurality of width adjusters attached to the top of the top tubes; and modifying a plurality of longitudinal guides at a top of each end of the well car.

11. The method of claim 10, wherein the step of modifying the plurality of longitudinal guides at the top of each end of the well car comprises:

removing each longitudinal guide and corresponding guide rail assemblies from a top bulkhead angle of the end assembly, wherein each guide rail assembly includes a first pair of gussets;

attaching a second pair of gussets for each longitudinal guide on the top bulkhead angle; and reattaching each guide rail assembly followed by corresponding longitudinal guides so that the first and second pairs of gussets form a slip joint that is slidably adjustable to adjust the length of the well car between the longitudinal guides on opposing ends of the well car.

12. The method of claim 11, wherein the top tubes and the shear plate are cut at a location such that when both ends of the well car are shortened and the interfaces of the longitudinal guide gussets are adjusted, the length of the well car comprises at least one of 20 feet and 40 feet within a tolerance of ½ an inch.

13. A method of shortening an end of a well car having at least four inside corners, the method comprising:

removing a plurality of parts that would inhibit the shortening process, or that need to be modified later in the shortening process;

cutting a set of top tubes at a location on a well side of an end assembly;

cutting a shear plate and a set of side sill angles at said location on the well side of the end assembly, thereby causing the end assembly to become detached from a main body of the well car;

on each side of the main body:

cutting the top tube at a location above a monument plate that is just beyond a reinforcement plate attached to the monument plate;

cutting through a weld between the monument and reinforcement plates and a side sheet;

cutting through the side sheet generally at the attachment location of the monument and reinforcement plates;

cutting the shear plate of the main body with a contoured cut such that the remaining shear plate has a contoured pattern substantially matching the cut shear plate under the detached end assembly;

removing, from each side of the well car, the reinforcement plate and the cut portions of the top tube and the side sheet; and removing the cut shear plate from the main body.

14. The method of claim 13, wherein removing a plurality of parts comprises at least one of:

removing a plurality of container guides, corner posts, and corner post reinforcements from the inside corners of the well car;

removing a plurality of longitudinal running boards and board brackets from the top of the top tubes; and removing a plurality of kick plates from the top of the top tubes.

15. The method of claim 13, wherein the step of cutting the weld comprises preserving a portion of the weld between the side sheet and the monument plate by trimming, with a diagonal cut, an outside edge of the monument plate when cutting through the weld.

16. The method of claim 15, wherein the removed portion of the top tube is about 3 feet 8⅞ inches long, and wherein the removed portions of the reinforcement plate, the side sheet, and the shear plate each have a length slightly shorter than that of the removed portion of the top tube.

17. The method of claim 13, further comprising on each side of the well car:

chamfering the cut edge of at least one of the top tube of the main body and the top tube of the end assembly;

cutting a notch from the monument plate so as to receive therein the top tube of the end assembly; and defining at least one slot through the contoured pattern of the shear plate through which to weld the end assembly back onto the contoured pattern of the shear plate.

18. The method of claim 17, further comprising:

cutting and removing a section of the side sill angle from each side of the end assembly;

removing the cut shear plate from beneath the end assembly; and grinding the underside of the end assembly where the side sill angle sections and the shear plate were removed.

* * * * *